United States Patent [19]

Fennes

[11] Patent Number: 4,603,518

[45] Date of Patent: Aug. 5, 1986

[54] COLLAPSIBLE MOBILE BUILDING

[76] Inventor: Walter Fennes, Hauptstrasse 115a, A-2372 Giesshübl, Austria

[21] Appl. No.: 716,893

[22] Filed: Mar. 28, 1985

[30] Foreign Application Priority Data

Apr. 2, 1984 [DE] Fed. Rep. of Germany ..... 3412048

[51] Int. Cl.[4] ..... E04B 1/343; E04B 7/16; B60P 3/34

[52] U.S. Cl. ..... 52/66; 52/64; 52/79.5; 296/27

[58] Field of Search ..... 52/79.5, 68, 66, 64; 296/27

[56] References Cited

U.S. PATENT DOCUMENTS

| | | | |
|---|---|---|---|
| 3,352,596 | 11/1967 | Escoto | 52/66 |
| 3,596,416 | 8/1971 | Hojka | 52/64 |
| 4,114,942 | 9/1978 | Greiner | 52/66 |
| 4,165,117 | 8/1979 | Kaiser | 52/66 |
| 4,546,578 | 10/1985 | Behrmann | 296/27 |

*Primary Examiner*—John E. Murtagh
*Assistant Examiner*—C. Dennison
*Attorney, Agent, or Firm*—Peter K. Kontler

[57] ABSTRACT

A collapsible building which is mounted on the platform of a conveyance has a first elongated unit which is mounted on the platform, and a pair of collapsible elongated units which flank the first unit when the building is fully erected. Each collapsible unit has a base portion including a floor and sidewalls, and a separable roof. The roof is connected to the respective base portion by two pairs of links at the front and rear ends of the respective collapsible unit and each base portion is pivotable relative to the first unit about a horizontal axis extending along the respective side adjacent to the bottom of the first unit. The links compel the roofs to move relative to the respective base portions when the base portions are pivoted by hydraulic motors between upright positions adjacent to the respective sides of the first unit and second positions in which they confine of the first unit. The roofs remain at least substantially horizontal during pivoting of the respective base portions and the roofs overlie the first unit in the second positions of the respective base portions.

20 Claims, 8 Drawing Figures

COLLAPSIBLE MOBILE BUILDING

BACKGROUND OF THE INVENTION

The present invention relates to mobile buildings in general, and more particularly to improvements in collapsible buildings which are intended to be transported to different locales of use. Still more particularly, the invention relates to improvements in mobile buildings of the type wherein one or more collapsible units are movable relative to at least one more or less permanently erected unit.

Mobile buildings of the above outlined character are often used as field hospitals, workshops, warehouses, dormitories, temporary schools, personnel training centers, temporary homes at camping sites and for many other purposes. It is known to mount such buildings on the platforms of trucks or other types of motor vehicles for rapid transport from a first to a different second locale of use and to assemble the buildings in such a way that one or more units can be collapsed or otherwise caused to move away from their normal erected positions in order to reduce the overall dimensions of the buildings, either for storage or for transport. For example, the collapsible units can be caused to enter the non-collapsible unit so that the overall width and length of the thus dismantled building do not appreciably exceed the corresponding dimensions of the non-collapsible unit. It is further known to provide a diesel generator or another suitable prime mover which is designed to effect the movements of the collapsible unit or units relative to the more or less permanently erected unit.

In accordance with a presently known proposal, two collapsible or movable units flank a centrally located non-collapsible unit when the building is fully erected, and the collapsible units then rest on the ground at the respective lateral sides of the non-collapsible unit. When the building is to be made ready for storage or transport, the roofs of the two collapsible units are detached from the remaining (base) portions of the respective collapsible units and are placed next to and affixed to the outer sides of upright sidewalls of the respective units. Such operation necessitates the utilization of cranes which are not invariably available at the locale where the buildings are to be erected or dismantled. Moreover, the tops of the collapsible units remain open during removal of their roofs, during attachment of the removed roofs to the respective sidewalls, as well as during movement of the collapsible units relative to the non-collapsed or non-collapsible unit. Still further, the lifting of roofs above and away from the respective base portions and the changes in orientation of detached roofs (from a substantially horizontal to a substantially vertical position for placing next to the respective sidewalls) can be carried out only in the absence of pronounced winds. Even a moderate wind can cause an interruption of the erecting or dismantling operation in view of the large dimensions of the separable roofs. It is not unusual that circumstances (particularly winds) beyond the control of persons in charge cause delays of several days or even weeks, which is evidently unacceptable if the collapsible building is to be used as an emergency hospital, an emergency shelter or the like. As a rule, the erection or dismantling of such types of collapsible buildings necessitates the presence of a crew of at least three experienced workmen as well as the availability of a crane. The need for the presence of several qualified persons and for the availability of heavy-duty equipment contributes significantly to the cost of erection or dismantling and frequently causes pronounced delays in the erection or dismantling of the buildings.

OBJECTS AND SUMMARY OF THE INVENTION

An object of the invention is to provide a novel and improved collapsible building which is constructed and assembled in such a way that winds, storms, gales and like adverse atmospheric conditions cannot interfere with its erection or dismantling.

Another object of the invention is to provide a collapsible building which can be assembled or dismantled without the utilization of cranes or other types of heavy-duty equipment.

A further object of the invention is to provide a building which can be erected or dismantled by a single person with a minimum of training or written instructions.

An additional object of the invention is to provide novel and improved units which can be assembled into a collapsible building of the above outlined character.

Still another object of the invention is to provide a collapsible building which can be readily mounted on the platform of a truck or another motor vehicle and wherein the collapsible unit or units are connected to and movable relative to the remaining unit or units in a novel and improved way.

A further object of the invention is to provide a collapsible building wherein the separable roofs of collapsible units overlie the base portions of the respective collapsible units during erection or dismantling of the building to thus reduce the likelihood of penetration of snow, rain or other forms of precipitation into the collapsible units during erection or dismantling of the building.

An additional object of the invention is to provide the building with one or more novel and improved collapsible units whose roofs need not be manipulated by cranes and whose roofs need not be affixed to the sidewalls of the respective base portions.

Another object of the invention is to provide a novel and improved method of erecting and dismantling a collapsible mobile building for use as an emergency hospital, temporary dwelling, warehouse and/or for many other purposes.

The invention is embodied in a collapsible building which comprises a first unit having a first lateral side and a second lateral side, a collapsible second unit which includes a base portion having (a) a bottom or floor and sidewalls and (b) a roof which is separable from the base portion, a joint (e.g., an elongated hinge) pivotally connecting the base portion to the first unit for movement about a horizontal axis which is adjacent to and extends along one side of the first unit so that the base portion is movable through a plurality of intermediate positions between an upright first position adjacent to the one side of the first unit and a second position in which the base portion is at least substantially confined in the interior of the first unit or vice versa, and guide means for imparting to the roof a movement along a predetermined path relative to the base portion and in automatic response to movement of the base portion so that the roof is located at a level above the base portion in the first position and above the first unit in the second position of the base portion. The roof is or can be at least substantially flat and is at least substantially horizontal, at least in the second position of the base portion, preferably in each and every intermediate as well as in the first position of the base portion (save for the inclination which may be desirable or necessary to permit water or other forms of precipitation to flow or slide off the roof in the first and/or second position of the base portion).

The first unit is preferably elongated so that it resembles or can resemble the cargo compartment of a large trailer truck and has a front side and a rear side. The guide means for the roof can comprise a first pair of links at the front side and a second pair of links at the rear side of the first unit. A first portion of each link is articulately connected to the base portion and a second portion (which is spaced apart from the first portion) of each link is articulately connected to the roof so that the links and the roof can be said to constitute or operate not unlike a parallel motion mechanism. The building preferably further comprises a fixed bearing which is disposed between the first and second lateral sides of the first unit at a level below the roof, and the guide means can further comprise an elongated connecting member (e.g., a bar or rod) the first end portion of which is articulately connected to the bearing and the second end portion of which is articulately connected to the roof. The first unit and the bearing can be mounted on a mobile platform, e.g., on the platform of a large overland trailer truck.

The improved collapsible building preferably further comprises means for moving the base portion of the second unit between the first and second positions. Such moving means can include at least one fluid-operated motor having two components (e.g., a cylinder and a piston rod) which are movable relative to each other. One of these components is rigidly or articulately connected to the first unit and the other component is articulately connected to the second unit, e.g., to the aforementioned connecting member or to the base portion of the second unit, especially to an arm which is rigidly affixed to the underside of the floor of the base portion. The motor is preferably disposed at a level below the first unit, at least when the base portion of the second unit is held in the first position. The motor preferably constitutes a double-acting hydraulic cylinder and piston assembly. It is also possible to construct the motor in such a way that one of its components forms part of the guide means for the roof.

Alternatively, the means for moving the base portion of the second unit between its first and second positions can comprise a lever which is pivotable about a fixed axis, a link which couples one arm of the lever to the base portion of the second unit, and a motor (e.g., a double-acting hydraulic cylinder and piston assembly mounted at a level below the first unit) for transmitting motion to another arm of the lever whereby the link pulls the base portion of the second unit to the second position and pushes the base portion to the first position or vice versa.

The collapsible housing can further comprise a third unit including a base portion and a roof which is separable from the base portion, a joint which pivotally connects the base portion of the third unit to the first unit for movement about a horizontal axis which is adjacent to and extends along the other lateral side of the first unit so that the base portion of the third unit is movable through a plurality of intermediate positions between an upright first position adjacent to the other side of the first unit and a second position in which the base portion of the third unit is at least substantially confined in the interior of the first unit or vice versa, and guide means for imparting to the roof of the third unit a movement along a predetermined path relative to the base portion of the third unit in automatic response to movement of the base portion of the third unit so that the roof of the third unit is located at a level above and covers the base portion of the third unit in the first position and above the first unit in the second position of the base portion of the third unit. The roof of the third unit is preferably flat or substantially flat and is at least substantially horizontal, at least in the second position of the base portion of the third unit. The second and third units are preferably mirror symmetrical to each other with reference to the first unit when their base portions assume the upright first positions.

Each of the units is preferably elongated, as considered in the direction of the respective horizontal axis. As a rule, the building will be designed in such a way that the base portions of the second and third units confine the first unit when such base portions assume their second positions. The width of the first unit, as measured at right angles to the horizontal pivot axes, preferably approximates or equals the width of a trailer truck so that the housing can be transported on roads in the same way as the trailer of a truck. In fact, the first unit can constitute an integral or separable part of a wheel-mounted conveyance.

The novel features which are considered as characteristic of the invention are set forth in particular in the appended claims. The improved building itself, however, both as to its construction and the mode of erecting and dismantling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
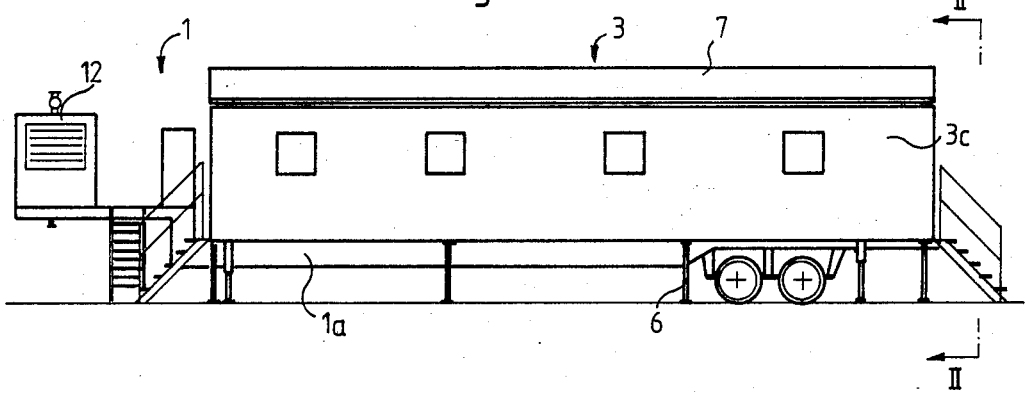
FIG. 1 is a side elevational view of a collapsible mobile building with two collapsible units one of which can be seen in fully erected position.
Figure 2:
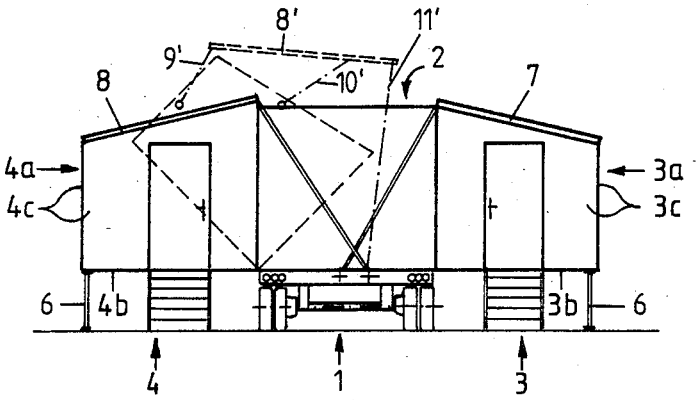
FIG. 2 is a rear elevational view of the building as seen in the direction of arrows from the line II—II in FIG. 1.

Referring first to FIGS. 1 and 2, there is shown a motor vehicle 1 whose wheel-mounted platform 1*a* supports the first unit 2 of a three-unit collapsible building embodying one form of the invention. The building further includes a second unit 3 at one side and a third unit 4 at the other side of the first unit 2. The units 3 and 4 are mirror symmetrical to each other with reference to the central longitudinal vertical symmetry plane of the first unit 2. The unit 3 comprises a base portion 3*a* including a bottom or floor 3*b* and upstanding sidewalls 3*c* as well as a detachable flat plate-like roof 7. Analogously, the unit 4 comprises a base portion 4*a* with a floor 4*b* and sidewalls 4*c* as well as a detachable flat plate-like roof 8. The base portions 3*a* and 4*a* have legs 6 which contact the ground when the building is fully erected. FIG. 2 further shows that the rear sidewalls 3*c*, 4*c* of the base portions 3*a*, 4*a* are provided with doors and that the base portions 3*a*, 4*a* can be equipped with stairs or steps for convenient access to the interior of the respective collapsible units 3 and 4. The width of the first unit 2 equals or approximates the width of the platform 1*a* of the motor vehicle 1, and the width of each of the two collapsible units 3 and 4 matches or approximates the width of the unit 2. The legs 6 are optional because the outermost parts of the floors 3*b*, 4*b* can rest on bricks, beams or the like, or the guide means (including elongated connecting members 11 shown in FIGS. 5 and 6) can be used to safely hold the base portions 3*a* and 4*a* in upright positions even if the floors 3*b* and 4*b* do not contact the ground.

Figure 3:
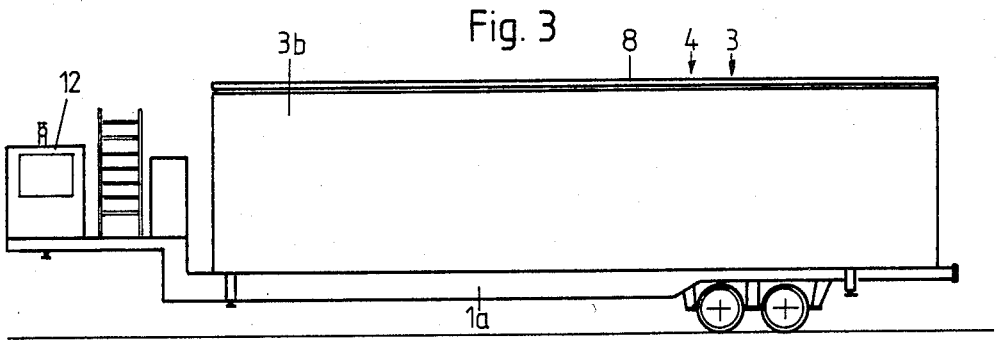
FIG. 3 is a side elevational view of the building with the base portions of the two collapsible units in their second positions.
Figure 4:
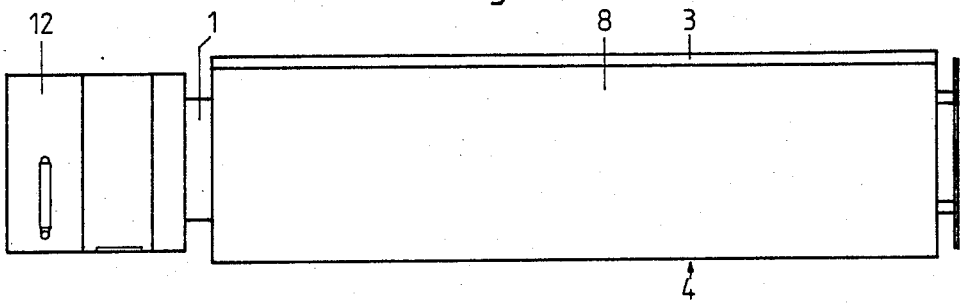
FIG. 4 is a plan view of the building of FIG. 3, showing the roof of one of the collapsible units on top of the roof of the other collapsible unit and on top of the first unit.

FIGS. 3 and 4 show the building in dismantled condition, i.e., with the unit 2 confined in the units 3 and 4 and the motor vehicle 1 ready to transport the building to a different locale. As can be seen in FIG. 4, the width of the dismantled building does not appreciably exceed the width of the first unit 2.

Figure 5:
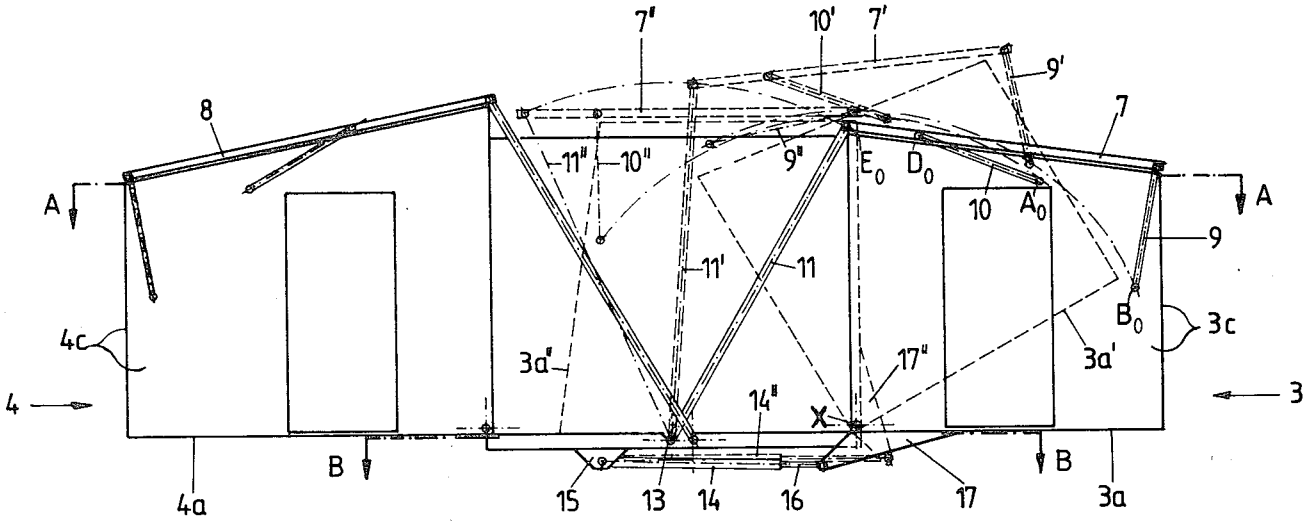
FIG. 5 is an enlarged somewhat schematic view of the structure of FIG. 2, the upright positions of the base portions of the two collapsible units being shown by solid lines, an intermediate position of one of the base portions being shown by broken lines and the second position of the one base portion being shown by phantom lines.

Referring to FIG. 5, the first or upright positions of the base units 3*a*, 4*a* of the collapsible units 3 and 4 are shown by solid lines. An intermediate position of the base portion 3*a* of the unit 3 is shown by broken lines at 3*a*', and the second position of the base portion 3*a* is indicated by phantom lines at 3*a*''. The corresponding positions of the separable roof of the unit 3 are also shown by solid, broken and phantom lines, as at 7, 7' and 7''. The unit 3 is pivotable relative to the unit 2 about the axis of a horizontal joint X (e.g., a hinge or a series of hinges) which is adjacent to the respective lateral side of the unit 2 and is close to the floor 3*b* of the base portion 3*a*. The guide means for imparting to the roof 7 a movement along a predetermined path (from the solid-line position, through the position 7' and to the position 7'') when the base portion 3*a* is pivoted from the solid-line position to the phantom-line position 3*a*'' of FIG. 5 includes a first pair of links 9, 10 in the region of the rear side of the unit 2, a similar second pair of links 9, 10 at the front side of the unit 2, and at least one elongated connecting member 11. One end portion of each link is articulately connected to the corresponding sidewall 3*c* of the base portion 3*a*, the other end portion of each link is articulately connected to the roof 7, the lower end portion of the connecting member 11 is articulately connected to a bearing member 13 which is disposed on the platform 1*a* or on the floor of the unit 2 midway between the lateral sides of the unit 2, and the upper end portion of the connecting member 11 is articulately connected to the roof 7. The dimensions and distribution of the links 9, 10 and connecting member or connecting members 11 are such that the roof 7 remains at least substantially horizontal in each and every position of the base portion 3*a* and overlies the roof of the unit 2 when the base portion 3*a* assumes the second position 3*a*''. The intermediate positions of the links 9, 10 and connecting member 11 shown in FIG. 5 are denoted by the characters 9', 10' and 11', and the second positions of such parts (corresponding to the position 3*a*'' of the base portion 3*a*) are denoted by the characters 9'', 10'' and 11''.

Figure 6:
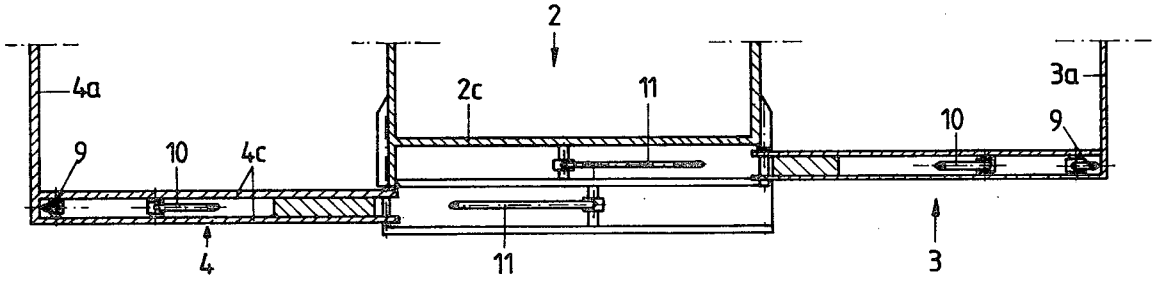
FIG. 6 is an enlarged fragmentary horizontal sectional view of the erected building as seen in the direction of arrows from the line A—A of FIG. 5.

The manner in which the base portion 4*a* and the roof 8 of the collapsible unit 4 are movable relative to the unit 2 is identical to the manner of moving the base portion 3*a* and the roof 7 of the collapsible unit 3. Reference may also be had to FIG. 6 which shows the building in fully erected position. It will be seen that the links 9 and 10 are concealed between the panels of the respective sidewall 3*c* of the base portion 3*a*, and that the links 9, 10 for the roof 8 (not shown in FIG. 6) are concealed between the panels of the corresponding sidewall 4*c* of the base portion 4*a*. The links 11 for the roofs 7 and 8 are outwardly adjacent to the respective (front or rear) side of the first unit 2. FIG. 6 also shows that the twin-panel sidewalls 3*c* and 4*c* of the base portions 3*a* and 4*a* can be moved in front of the respective sidewall 2*c* of the unit 2 when the base portions 3*a*, 4*a* are moved to their second positions and that the twin panel 3*c* is then located between the twin panel 4*c* and the sidewall 2*c*. In other words, the base portion 3*a* can receive the unit 2 and the base portion 4*a* can receive the base portion 3*a*.

The front end portion of the platform 1*a* carries a generator 12 which supplies electrical energy to the current consuming fixtures and/or other electrically operated devices in the erected building. Moreover, the generator 12 can supply energy to the means for moving the base portions 3*a*, 4*a* and the roofs 7, 8 relative to each other and relative to the unit 2.

Referring again to FIG. 5, the base portion 3*a* reaches the intermediate position 3*a*' after an angular movement about the axis of the joint X through approximately 30° starting from the solid-line (upright or first) position of the base portion 3*a*. The base portion 3*a* reaches the second position 3*a*'' after an angular movement through approximately 90°. The upper end portion of the connecting member 11 is articulately connected to that part of the roof 7 which is nearest to the roof of the unit 2 when the base portion 3*a* is held in the first position which is indicated by solid lines. The roof 7 and the links 9 and 10 can be said to constitute a parallel motion mechanism which ensures that the inclination of the roof 7 does not change appreciably (i.e., that it does not deviate substantially from a horizontal position) during movement of the base portion 3*a* relative to the unit 2. This reduces the danger that winds could interfere with the erection or dismantling of the improved building.

The means for moving the base portion 3*a* between the solid-line position and the phantom-line position 3*a*'' of FIG. 5 includes a fluid-operated motor 14 having a first component (cylinder) attached to a bearing member 15 at the underside of the floor of the unit 2 and a second component 16 (piston rod) articulately connected to a rigid bifurcated arm 17 at the underside of the floor 3b of the base portion 3a. The generator 12 can drive a pump (not specifically shown) which supplies pressurized fluid medium (e.g., oil) to the cylinder of the motor 14 in order to move the base portion 3a from the first to the second position or vice versa. The arm 17 can comprise two spaced-apart parallel steel plates which are welded or otherwise fixedly secured to the underside of the floor 3b.

The locations where the link 9 of FIG. 5 is respectively connected to the corresponding sidewall 3c and roof 7 are denoted by the characters $B_O$ and $C_O$. The locations where the link 10 of FIG. 5 is respectively connected to the corresponding sidewall 3c and roof 7 are denoted by the characters $A_O$ and $D_O$. The locus of articulate connection between the upper end portion of the connecting member 11 and the roof 7 is denoted by the character $E_O$.

The means for moving the base portion 3a and the roof 7 relative to the unit 2 can comprise several motors 14, preferably double-acting hydraulic cylinder and piston assemblies which can be actuated by a single person in response to depression of suitable knobs or the like. As mentioned above, the roof 7 remains at least substantially horizontal in each and every position of the base portion 3a so that the presence or absence of winds during erection or dismantling of the building is of no consequence. One or more additional motors are provided to move the base portion 4a and the roof 8 of the collapsible unit 4 relative to the unit 2. The legs 6 are preferably pivotable relative to the respective base portions 3a and 4a so that they can be folded against the adjacent sides of the dismantled or collapsed building when the building is in storage or on the road.

Figure 7:
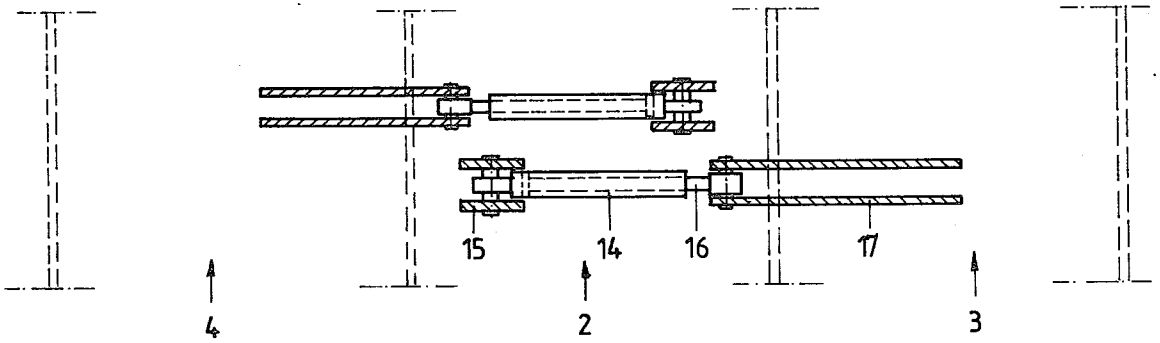
FIG. 7 is an enlarged fragmentary horizontal sectional view as seen in the direction of arrows from the line B—B of FIG. 5.

FIG. 7 shows the details of the manner in which the cylinder of a motor 14 can be affixed to the respective bearing member 15 at the underside of the unit 2 and the manner in which the piston rod 16 of such motor is connected to the plates of the arm 17 at the underside of the floor 3b.

Figure 8:
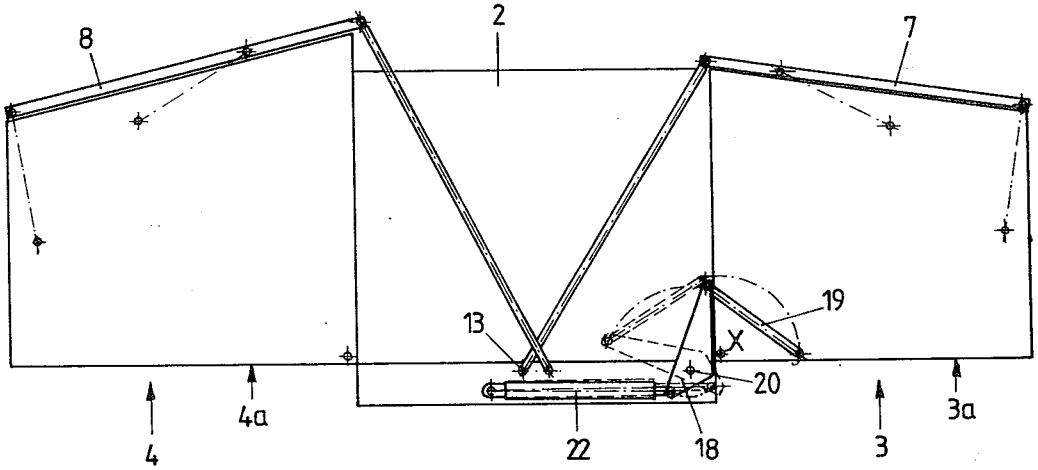
FIG. 8 is a view similar to that of FIG. 5 but showing one of two modified means for moving the base portions of the collapsible units relative to the first unit.

FIG. 8 shows schematically a modified collapsible mobile building wherein the base portion 3a of the unit 3 is pivotable about the axis of the horizontal joint X by modified moving means including a two-armed lever 18 which is fulcrumed at 20 (e.g., on the floor of the unit 2 or on the platform 1a), the longer arm of which is articulately connected with one end portion of a link 19, and the shorter arm of which is articulately connected to the piston rod of a double-acting fluid-operated (preferably hydraulic) cylinder and piston assembly 22. The cylinder of the assembly 22 is articulately connected to the floor of the unit 2 or to the platform 1a. The other end portion of the link 19 is articulately connected to the base portion 3a.

The manner in which the roof 7 of the unit 3 is moved relative to the base portion 3a during movement of the base portion 3a between its first and second positions is the same as described in connection with FIG. 5. Furthermore, the base portion 4a and the roof 8 of the unit 4 can be moved relative to the unit 2 in the same way as described in connection with the base portion 3a and roof 7 of the unit 3. Thus, the building comprises one or more additional motors 22 and a corresponding number of levers 18 and links 19 to move the base portion 4a relative to the unit 2.

The moving means of FIG. 8 exhibits the advantage that its parts need not extend laterally beyond the unit 2 when the units 3 and 4 are moved to their collapsed positions. In the embodiment of FIGS. 1 to 7, the arms 17 are outwardly adjacent to the respective lateral sides of the unit 2 when the building is dismantled to assume the shape shown in FIGS. 3 and 4.

Another advantage of the moving means which is shown in FIG. 8 is that the various forces which are developed by the double-acting motor 22 correspond to the ratio of various torques during pivoting of the base portion 3a about the axis of the joint X between the first and second positions.

The erection or dismantling of the improved building does not require the presence of a complete crew of skilled attendants. The driver of the motor vehicle 1 can operate the various moving means in order to move the unit 3 and/or 4 to the upright or collapsed position without the need for a crane or another piece of heavy-duty equipment. The erection and dismantling can be carried out without winches or analogous devices which utilize cables, i.e., parts that are subject to expansion and contraction, shortening and lengthening and other changes. Still further, the mobile parts of the improved building do not assume unstable positions during any stage of erection or dismantling which is in contrast to heretofore known proposals involving the use of cranes to maintain the roof or roofs in suspended (unstable) position preparatory to pivoting of the respective collapsible units to or from their upright positions. The improved building can be erected or dismantled within surprisingly short intervals of time, e.g., within an interval of 10 minutes. This is of considerable importance when the building is to be used as an emergency hospital, emergency shelter or the like.

The improved collapsible building is susceptible of many additional modifications. For example, the connecting members 11 can constitute the piston rods of double-acting hydraulic cylinder and piston assemblies so that such connecting members move the respective base portions 3a, 4a when the units 3 and 4 are to be moved between their erected and collapsed positions. Thus, certain components of the means for moving the base portions 3a, 4a between their first and second positions can constitute parts of the guide means for the roofs 7 and 8.

Alternatively, the piston rods of the motors 14 or 22 can be articulately connected to the connecting members 11 rather than to the arms 17 or levers 18.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A collapsible building, comprising a first unit having a first side and a second side; a second unit including a base portion and a roof which is separable from said base portion; a joint pivotally connecting said base portion to said first unit for movement about a horizontal axis which is adjacent to and extends along one side of said first unit so that said base portion is movable through a plurality of intermediate positions between an upright first position adjacent to said one side of the first unit and a second position in which one of said units is at least substantially within the confines of the other of said units; and guide means for imparting to said roof a movement along a predetermined path relative to said base portion and in response to movement of said base portion so that the roof is located at a level above the base portion in the first position and above said first unit in the second position of said base portion, the movement of said roof having a component in a direction transversely of said axis.

2. The building of claim 1, wherein said roof is at least substantially flat and is at least substantially horizontal, at least in the second position of said base portion.

3. The building of claim 2, wherein said first unit has a front side and a rear side and said guide means comprises a first pair of links at the front side and a second pair of links at the rear side of said first unit, each of said links having a first portion articulately connected to said base portion and a spaced-apart second portion articulately connected to said roof.

4. The building of claim 3, further comprising a bearing disposed between the first and second sides of said first unit at a level below said roof, said guide means further comprising an elongated connecting member having a first end portion articulately connected to said bearing and a second end portion articulately connected to said roof.

5. The building of claim 4, further comprising a mobile platform for said first unit, said bearing being provided on said platform.

6. The building of claim 1, further comprising means for moving said base portion between said first and second positions, including at least one fluid-operated motor having two components which are movable relative to each other, one of said components being connected to said first unit and the other of said components being articulately connected to said second unit.

7. The building of claim 6, wherein said motor is disposed at a level below said first unit and said second unit further comprises an arm provided on said base portion and articulately connected to the second component of said motor.

8. The building of claim 7, wherein said motor is a double-acting cylinder and piston assembly.

9. The building of claim 7, wherein said arm is rigidly affixed to and is located at a level below said base portion when the latter assumes said first position.

10. The building of claim 6, wherein said second component forms part of said guide means.

11. The building of claim 6, wherein said guide means comprises an elongated connecting member having a first end portion pivotable about a fixed axis and a second end portion articulately connected to said roof, said second component being arranged to pivot said connecting member and to thereby move said base portion between said first and second positions.

12. The building of claim 1, further comprising means for moving said base portion between said first and second positions, including a lever pivotable about a fixed axis and having an arm, a link coupling said base portion with said arm, and motor means for pivoting said lever.

13. The building of claim 12, wherein said lever has a second arm and said motor means includes a double-acting cylinder and piston assembly located at a level below said first unit.

14. The building of claim 1, further comprising a third unit including a base portion and a roof which is separable from the respective base portion, a joint pivotally connecting the base portion of said third unit to said first unit for movement about a horizontal axis which is adjacent to and extends along the other side of said first unit so that the base portion of said third unit is movable through a plurality of intermediate positions between an upright first position adjacent to said other side of the first unit and a second position in which one of said first and third units is at least substantially within the confines of the other of said first and third units, and guide means for imparting to the roof of said third unit a movement along a predetermined path relative to the base portion of said third unit in response to movement of the base portion of said third unit so that the roof of said third unit is located at a level above the base portion of the third unit in the first position and above said first unit in the second position of the base portion of said third unit.

15. The building of claim 14, wherein the roof of said third unit is at least substantially flat and is at least substantially horizontal, at least in the second position of the base portion of said third unit.

16. The building of claim 1, wherein said base portion has at least one leg which contacts the ground in the first position of said base portion.

17. The building of claim 1, wherein said units are elongated, as considered in the direction of said horizontal axis.

18. The building of claim 1, wherein the base portion of said second unit confines the first unit in the second position of said base portion.

19. The building of claim 1, wherein the width of said first unit, as measured at right angles to said axis, approximates or equals the width of a trailer truck.

20. The building of claim 1, wherein said first unit forms part of a wheel-mounted conveyance.

* * * * *